US009915490B2

(12) United States Patent
Gentilini et al.

(10) Patent No.: US 9,915,490 B2
(45) Date of Patent: Mar. 13, 2018

(54) FIREARM WITH AN IMPROVED ARMING MEMBER

(71) Applicant: FABBRICA D'ARMI PIETRO BERETTA S.P.A., Gardone val Trompia, Brescia (IT)

(72) Inventors: Claudio Gentilini, Brescia (IT); Giovanni Prandini, Brescia (IT)

(73) Assignee: Fabbrica D'Armi Pietro Beretta S.P.A., Brescia (IT)

( * ) Notice: Subject to any disclaimer, the term of this patent is extended or adjusted under 35 U.S.C. 154(b) by 0 days.

(21) Appl. No.: 15/306,853

(22) PCT Filed: May 20, 2015

(86) PCT No.: PCT/IB2015/053712
§ 371 (c)(1),
(2) Date: Oct. 26, 2016

(87) PCT Pub. No.: WO2015/177736
PCT Pub. Date: Nov. 26, 2015

(65) Prior Publication Data

US 2017/0059266 A1 Mar. 2, 2017

(30) Foreign Application Priority Data

May 23, 2014 (IT) ..... BS2014A0102

(51) Int. Cl.
*F41A 3/00* (2006.01)
*F41A 17/72* (2006.01)
(Continued)

(52) U.S. Cl.
CPC ..... *F41A 17/72* (2013.01); *F41A 19/10* (2013.01); *F41A 19/32* (2013.01)

(58) Field of Classification Search
CPC ..... F41A 17/22; F41A 19/31; F41A 19/32
(Continued)

(56) References Cited

U.S. PATENT DOCUMENTS 1,344,991 A * 6/1920 Cunningham ..... F41A 3/26 42/16
2,341,298 A * 2/1944 Sweany ..... F41A 19/16 42/69.02

(Continued)

OTHER PUBLICATIONS

Italian Search Report for IT BS2014A000102 dated May 18, 2015.
International Search Report for PCT/IB2015/053712 dated Mar. 22, 2016.

*Primary Examiner* — Samir Abdosh
(74) *Attorney, Agent, or Firm* — Thomas Horstemeyer, LLP

(57) ABSTRACT

A firearm (1) comprising a firing mechanism. (600) comprising a trigger (601), a firing pin (6), a locking element (7) of the firing pin (6). The firearm comprises an arming device (10) comprising transmission means (50) connected to the trigger (601) and an arming member (100) comprising a plurality of engagement elements (151, 156, 157) suitable for engaging the transmission means (50) and/or the firing pin (6) and/or the locking element (7). The arming member (100) comprises: a) a firing pin operating body (110) for engagement with the firing pin (6); b) a lock operating body (120) for engagement with the transmission means (50) and with the locking element (7) of the firing pin (6), wherein the firing pin operating body (110) is engageable in rotation by the lock operating body (120) to be moved in rotation.

20 Claims, 9 Drawing Sheets

(51) Int. Cl.
*F41A 19/10* (2006.01)
*F41A 19/32* (2006.01)

(58) Field of Classification Search
USPC ..... 42/69.01, 69.02
See application file for complete search history.

(56) References Cited

U.S. PATENT DOCUMENTS

| | | | | | |
|---|---|---|---|---|---|
| 2,341,299 | A * | 2/1944 | Sweany | F41A 19/16 | 42/69.01 |
| 2,675,638 | A * | 4/1954 | Crittendon | F41A 19/45 | 42/69.01 |
| 2,716,923 | A * | 9/1955 | Gaidos | F41A 3/44 | 42/69.02 |
| 3,724,113 | A * | 4/1973 | Ludwig | F41A 19/47 | 42/70.08 |
| 5,050,481 | A * | 9/1991 | Knight, Jr. | F41A 5/06 | 42/69.02 |
| 5,267,407 | A * | 12/1993 | Bornancini | F41A 17/30 | 42/70.08 |
| 6,865,979 | B1 | 3/2005 | Vaid | | |
| 9,146,065 | B2 * | 9/2015 | Lee | F41A 19/10 | |
| 9,714,804 | B2 * | 7/2017 | Singh | F41A 17/70 | |
| 2011/0289811 | A1 * | 12/2011 | Gentilini | F41A 17/72 | 42/69.02 |
| 2013/0340309 | A1 * | 12/2013 | Lee | F41A 19/10 | 42/69.01 |
| 2014/0075813 | A1 * | 3/2014 | Lee | F41A 19/10 | 42/69.01 |
| 2015/0253096 | A1 * | 9/2015 | Lee | F41A 19/10 | 42/69.01 |
| 2016/0040949 | A1 * | 2/2016 | Lee | F41A 19/10 | 42/69.01 |
| 2016/0356568 | A1 * | 12/2016 | Kuracina | F41A 19/30 | |

* cited by examiner

FIREARM WITH AN IMPROVED ARMING MEMBER

CROSS-REFERENCE TO RELATED APPLICATION

This application is the 35 U.S.C. § 371 national stage application of PCT Application No. PCT/IB2015/053712, filed May 20, 2015, where the PCT claims priority to and the benefit of, IT Patent Application No. BS2014A000102, filed May 23, 2014, both of which are herein incorporated by reference in their entirety.

The present invention relates to a firearm comprising a firing device. Preferably, the firearm which the present invention relates to is a handgun; preferably, a semi-automatic handgun.

Arming devices are known of which are suitable to be operationally connected to the firing mechanism of the firearm in such a way as to effectively perform firing going to operate directly on firing pin, and not, for example, through the hammer.

Said known devices are generally located, at least partially, inside the firearm, preferably, in the back of the same. Preferably, said devices are also operatively connected to a support frame in turn located, at least partially, inside the stock of the firearm. The frame is designed to support the arming devices and the firing mechanism of the firearm.

Prior devices of different types exist characterised by different operating configurations having multiple mechanisms and different components composing them.

The prior arming devices are characterised by a movement mechanism such that a movement of the trigger results in a movement by suitable transmission means, preferably, in rotation, of an arming member suitable to engage and disengage the firing pin (in some embodiments even to pre-load it) as well as to move a locking element of the firing pin to place it in a locked position or an unlocked position in which the movement of the firing pin to perform actual firing is prevented or allowed.

An example of an arming member of this type is illustrated in the document US2011/0289811.

One of the main requirements related to this type of device is to be as responsive as possible, and thus be as "ready to fire" as possible.

The known devices, especially those characterised by a marked pursuit of readiness to fire are flawed by a series of problems as a result of which they present a degree of risk. In other words the known devices have a range of configurations in which the firearm is not in a safe configuration, but in an unsafe one i.e. a configuration in which the firing pin is free to move. If the firing pin is free to move, it may therefore happen that the firearm fires a shot, for example an accidental shot following a fall, or a plurality of shots in a burst, for example due to the translational motion typical of the firing mechanism of the firearm.

The purpose of the present invention is to make a firearm comprising an arming device which is not subject to this problem, i.e. to provide a firearm comprising an arming device in which the possibility of the firearm finding itself in an unsafe configuration is eliminated.

Such purpose is achieved by a firearm according to claim 1. In particular, the firearm according to the present invention resolves the problem of the prior art.

Further characteristics and advantages of the invention will be evident from the characteristics described below and claimed in the dependent claims. The characteristics and advantages of the firearm according to the present invention will be evident from the description given below, made by way of a non-limiting example, with reference to the attached drawings, wherein:

FIGS. 1*a* to 1*i*, 1*l*, and 1*m* respectively show a side view in cross-section of the rear portion of a firearm according to the present invention, during the various phases of the firing cycle, i.e. respectively in an initial configuration, a pre-stroke start configuration with the safety of the trigger pressed, a pre-stroke end and active stroke start configuration, a firing pin release configuration or i.e. end of active stroke, a firing configuration, a disconnection configuration, a retraction configuration, a reconnection configuration, a contact configuration between the locking element and the lock operating body, a return configuration to the battery, a reset configuration;

Figure 1A:
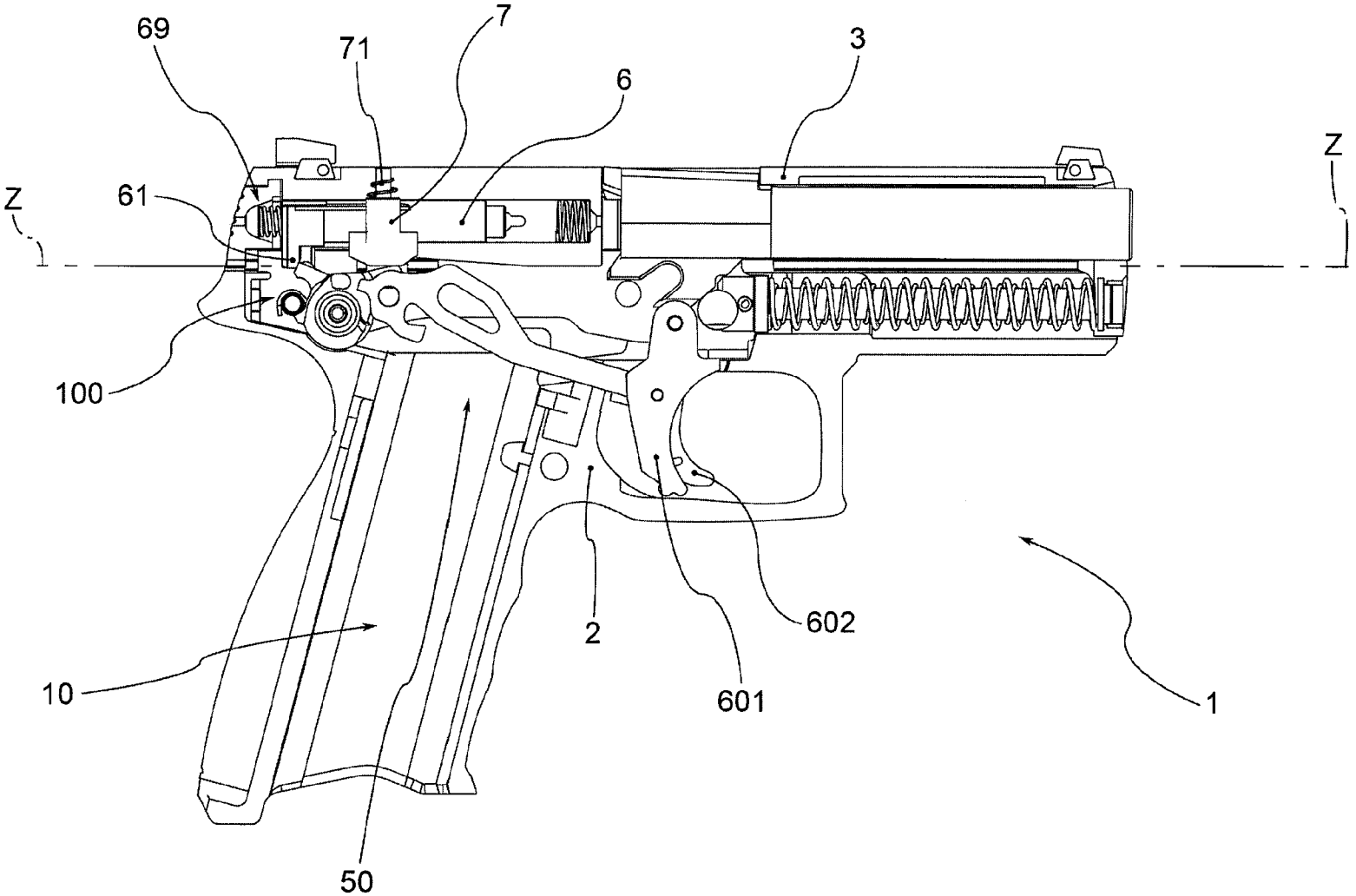
Figure 1B:
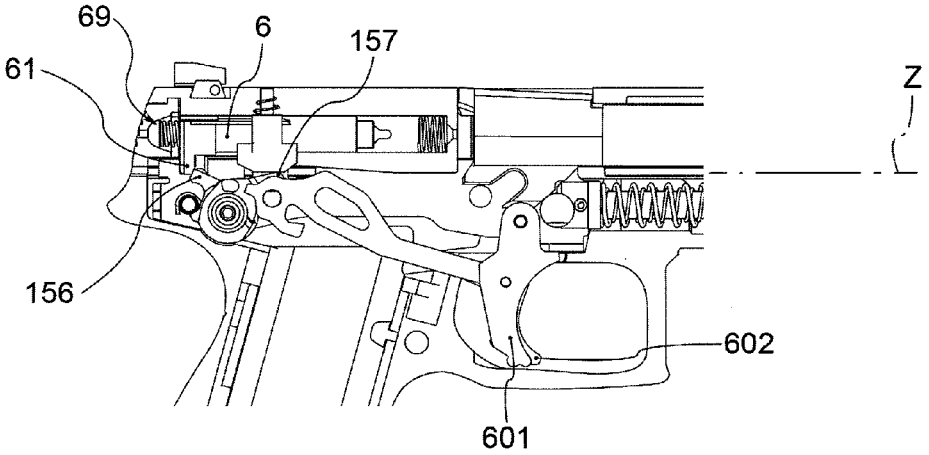
Figure 1C:
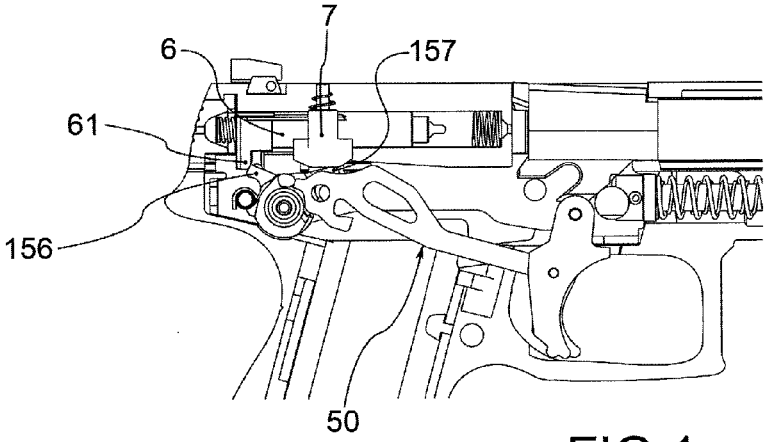
Figure 1D:
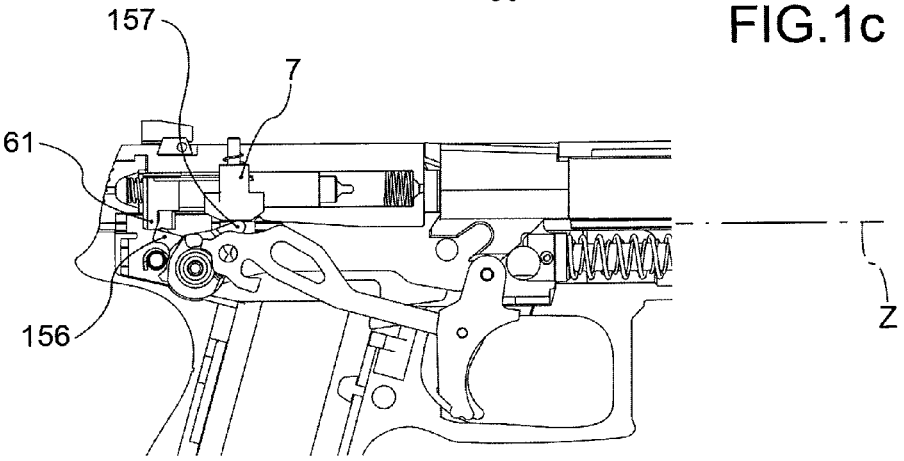
Figure 1E:
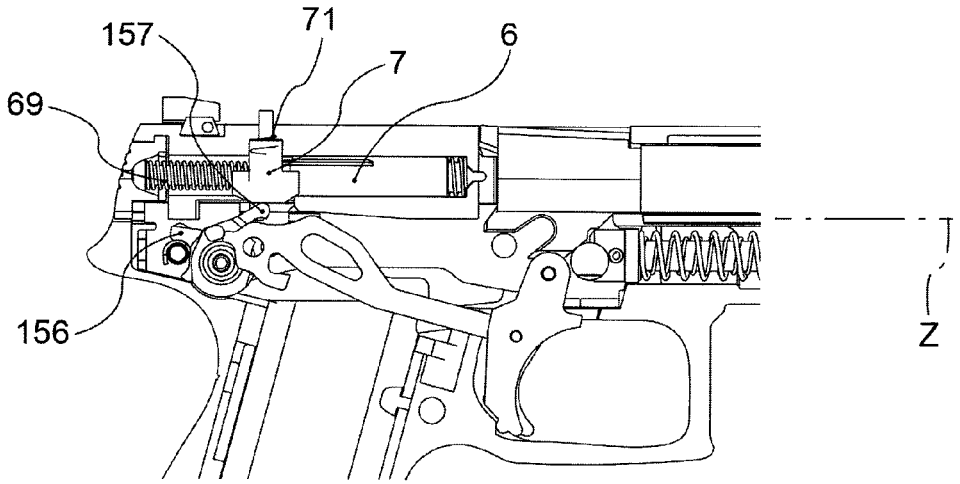
Figure 1F:
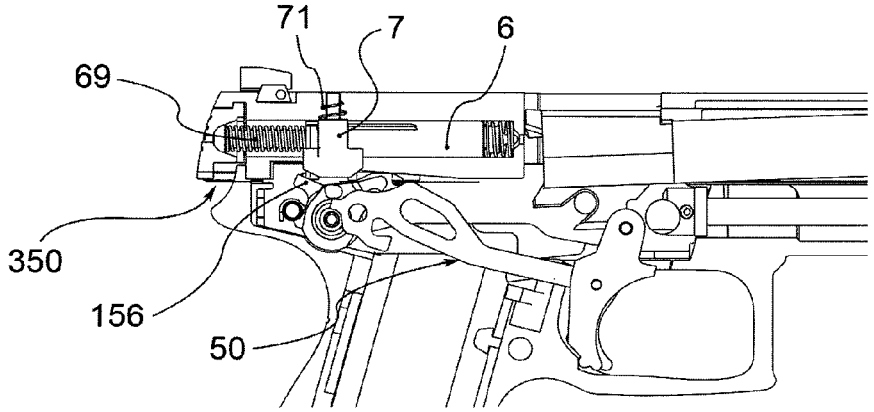
Figure 1G:
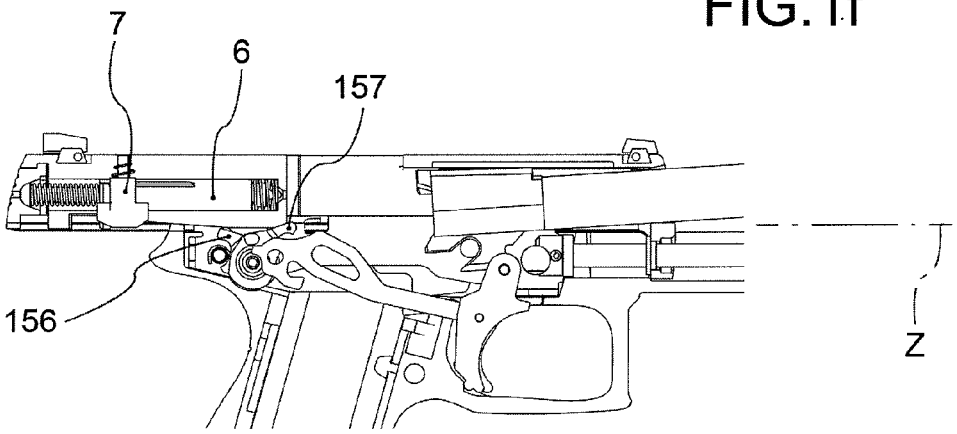
Figure 1H:
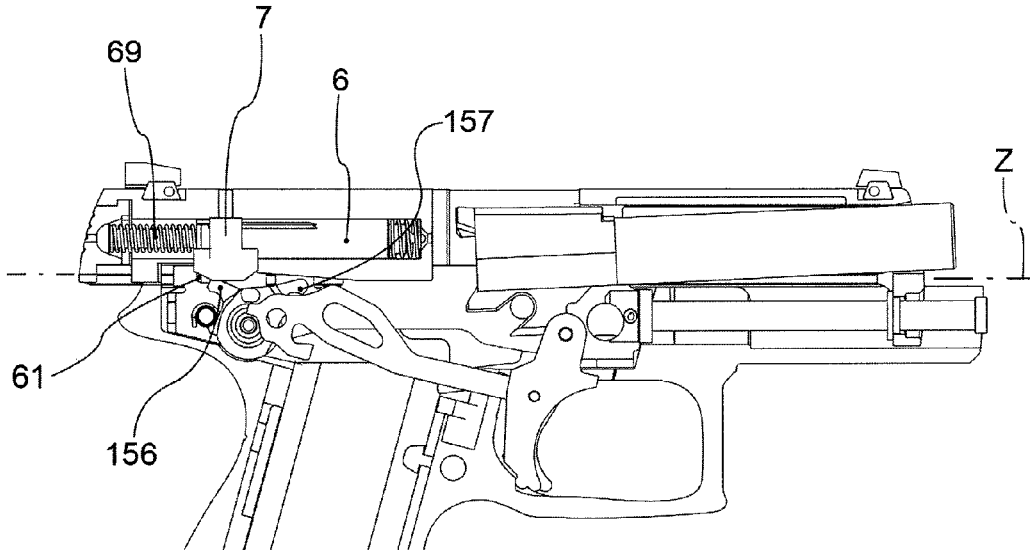
Figure 1I:
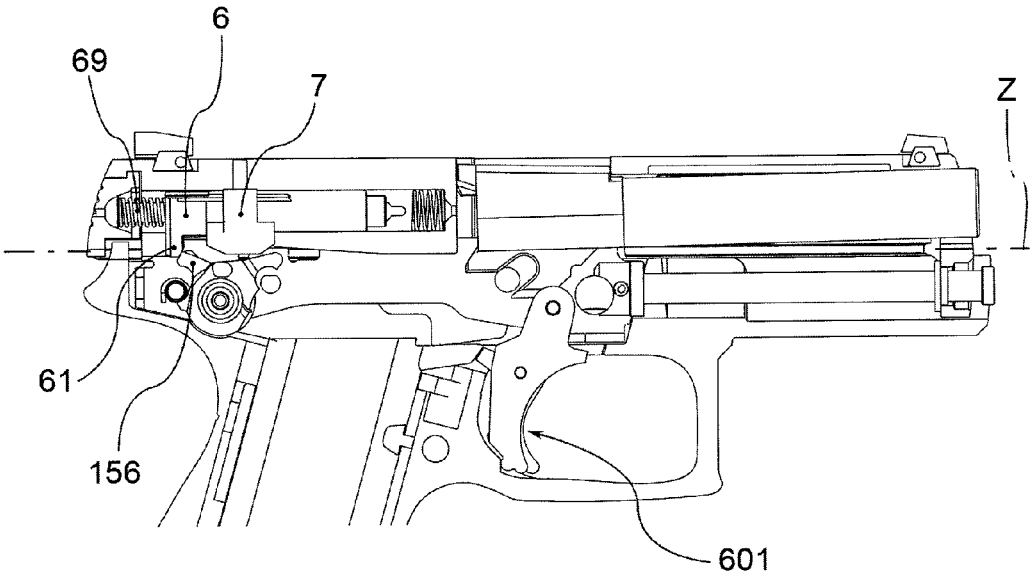
Figure 1L:
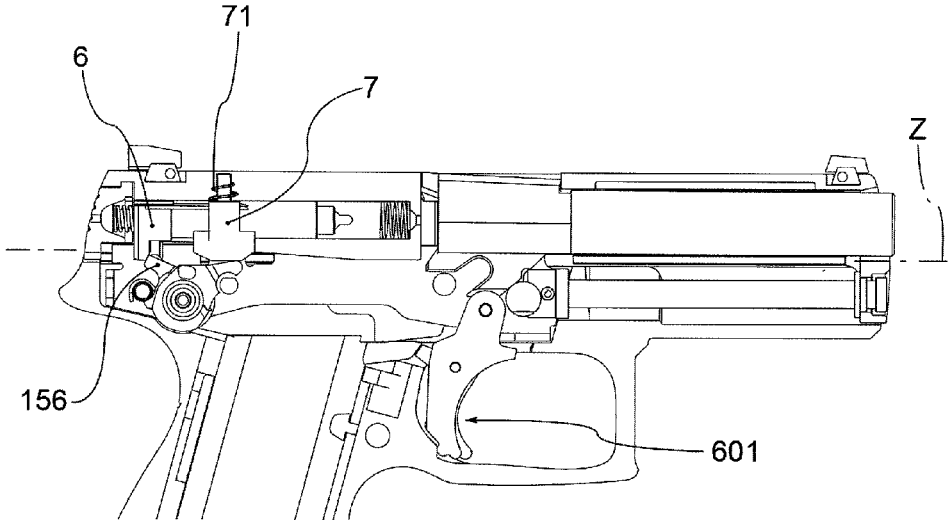
Figure 1M:
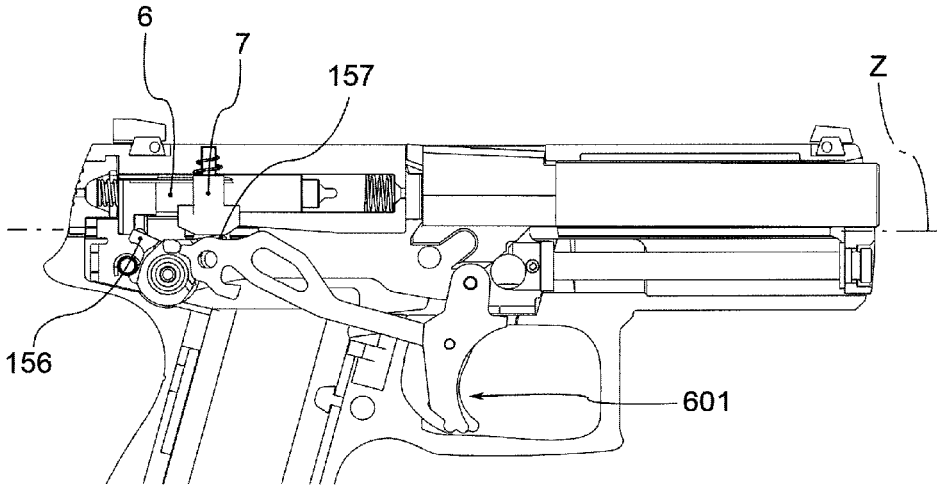
Figure 2:
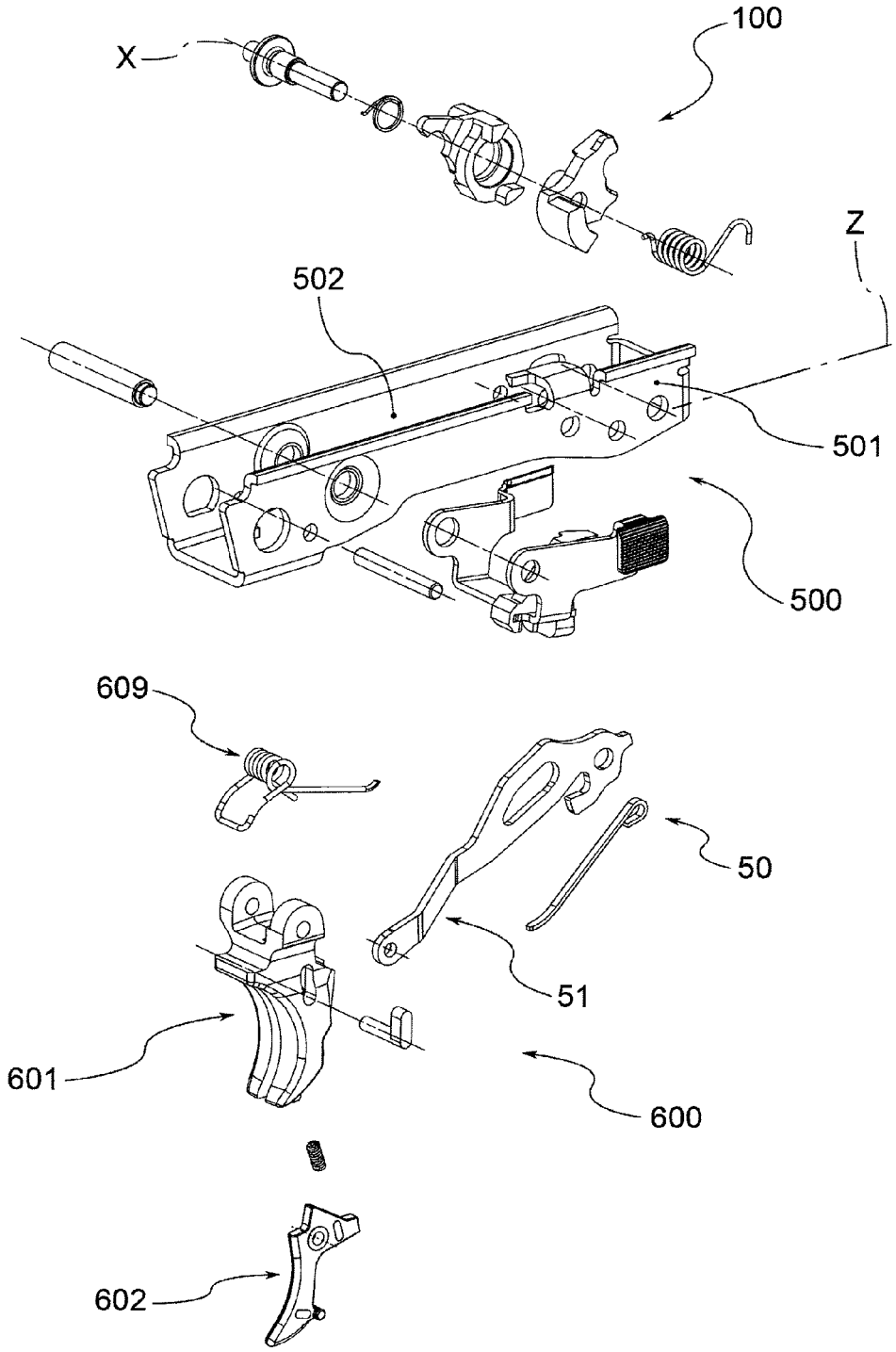
FIG. 2 is a perspective view in separate parts of a part of the firearm which the present invention relates to (showing some components of the firing mechanism and the arming device)
Figure 3:
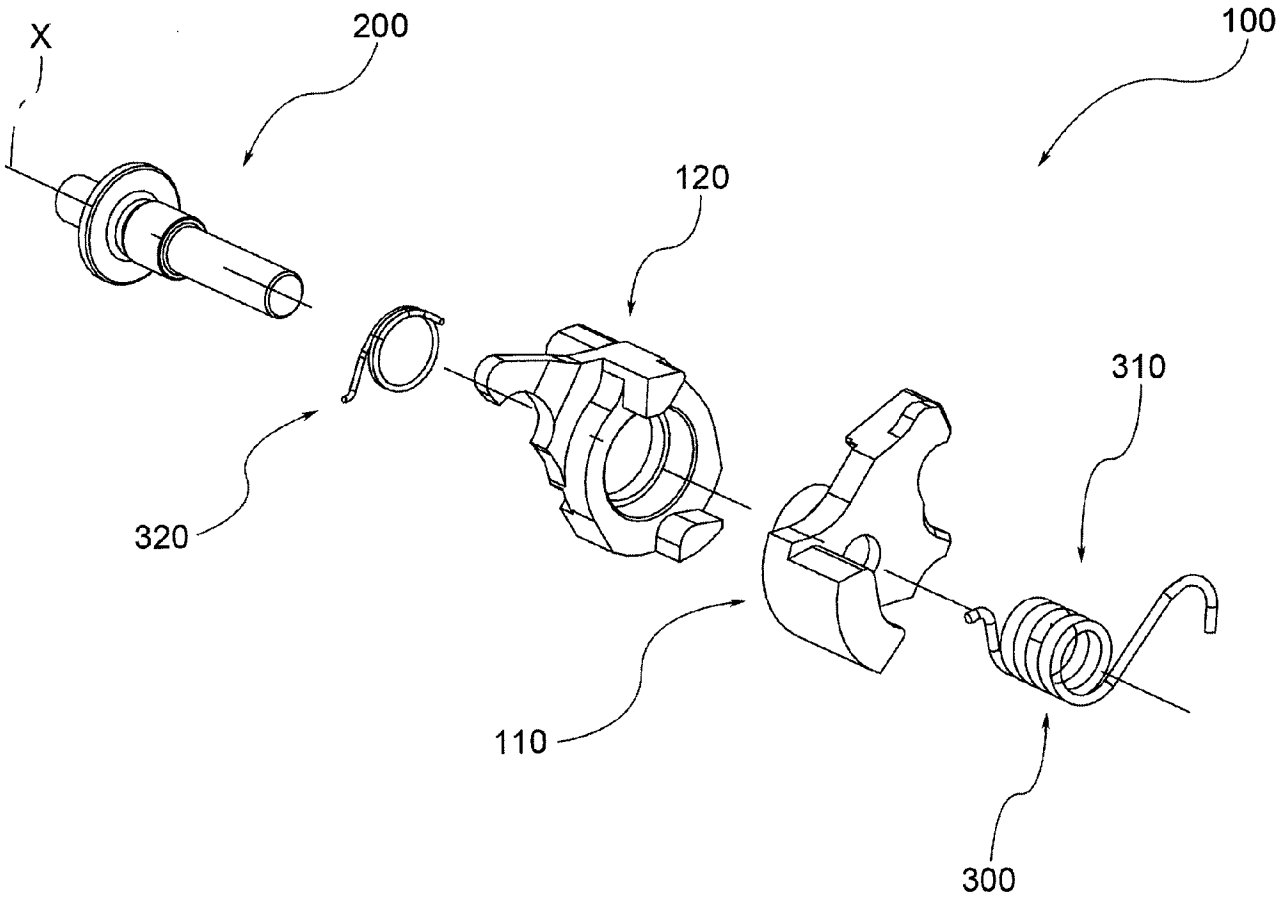
FIG. 3 shows a perspective view in separate parts of the arming member of the firearm according to the present invention, according to a first embodiment.
Figure 4A:
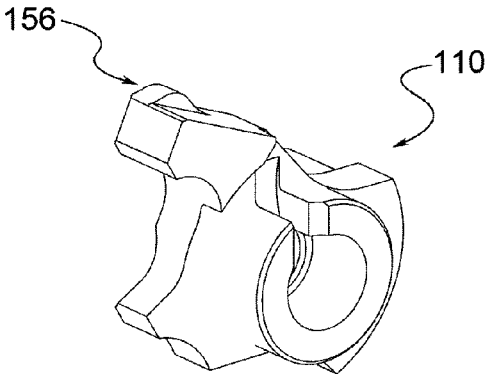
Figure 4B:
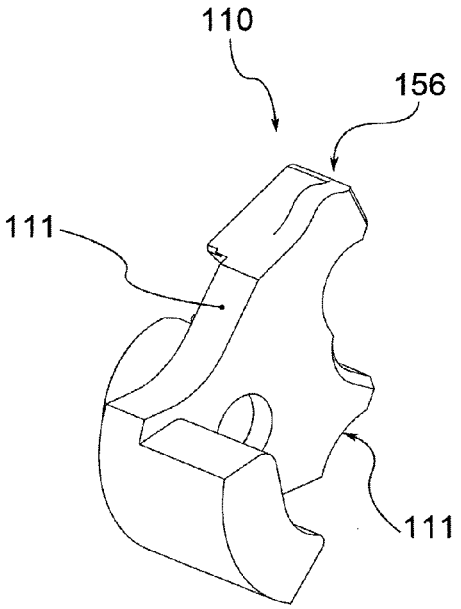
Figure 5A:
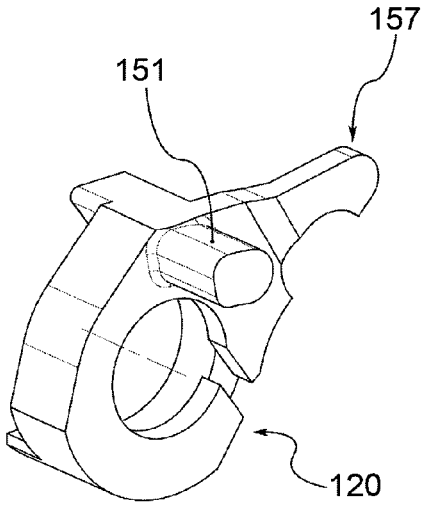
Figure 5B:
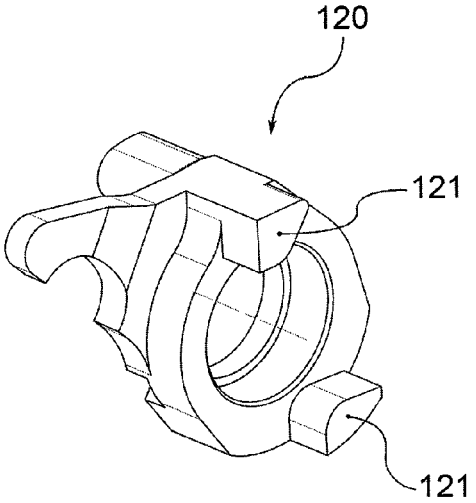
Figure 6:
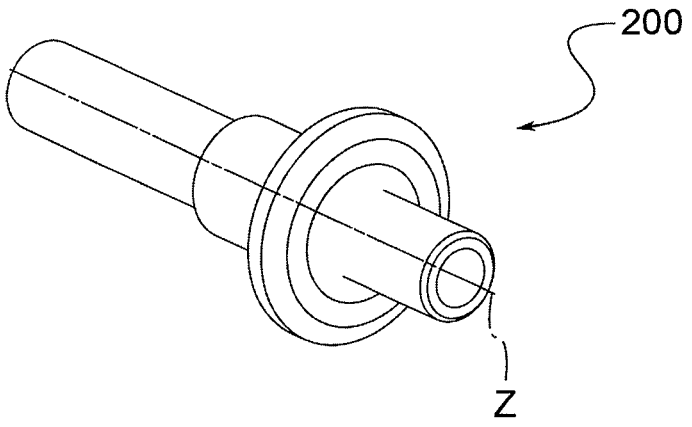
Figure 7A:
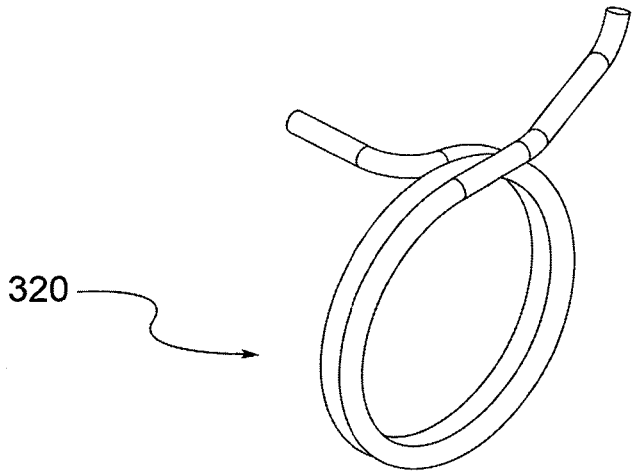
Figure 7B:
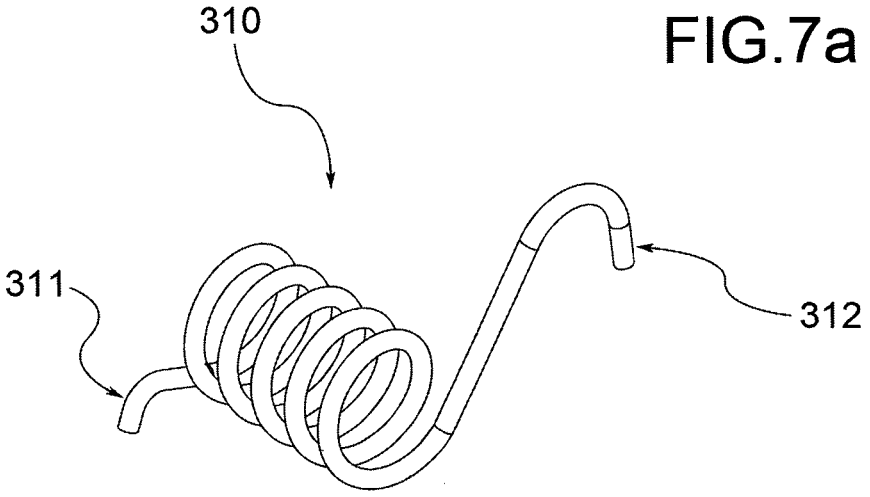

FIGS. 4*a* and 4*b* show two perspective side views of the firing pin operating body comprised in the arming member as in FIG. 3;

FIGS. 5*a* and 5*b* show two perspective side views the lock operating body comprised in the arming member as in FIG. 3;

FIG. 6 shows the support pin comprised in the arming member as in FIG. 3;

FIGS. 7*a* and 7*b* show the elastic means comprised in the arming member as in FIG. 3.

With reference to the appended drawings, reference numeral 1 globally denotes a firearm in its entirety, preferably, a hand gun, preferably, a semi-automatic hand gun; while reference numeral 10 indicates, instead, an arming/disarming device comprised in said firearm 1.

Preferably, the firearm 1 comprises a fixed part (a stock 2) and a moving part (a slide 3), suitable to perform the movements needed to fire the firearm 1. Preferably, the firearm 1 extends along a longitudinal axis Z-Z.

According to a preferred embodiment, the firearm 1 comprises a support frame 500 suitable to provide support to a firing mechanism 600 of the firearm 1, comprising a trigger 601; preferably, said frame also supports the arming/disarming device 10. According to a preferred embodiment, the trigger 601 comprises a safety lever 602 which must first be rotated to allow the subsequent rotation of said trigger 601.

Preferably, said frame 500 is housed at least partially inside the firearm 1, in particular in the stock 2, preferably, completely inside the firearm 1, said trigger 601 is rotatably engaged to said frame 500. Preferably, said support frame 500 extends in turn along said longitudinal axis Z-Z.

According to a preferred embodiment, the support frame 500 extends substantially near the sides of the firearm 1, especially in the rear area thereof where said arming device 10 is located. In fact, preferably, the frame 500 comprises a first 501 wing positioned substantially at the side of the firearm 1 suitable to cooperate and support the arming device 10. According to some embodiments, the frame 500 comprises two wings, said first wing 501 and a second wing 502; the two wings are positioned substantially at the sides of the firearm 1 one opposite the other and the arming/disarming device 10 engaged to both is thus supported on both sides.

According to said embodiments therefore the frame 500 extends along the longitudinal axis Z-Z with a substantially U or C-shaped cross-section. Preferably, the two wings 501 and 502 extend in height parallel to each other.

In addition, the firearm 1, especially its firing mechanism, comprises a firing pin 6 and a movable locking element 7 for the engagement or disengagement from said firing pin 6.

Preferably, the firing pin 6 is suitable to move along the longitudinal axis Z-Z, while the locking element 7 is moved transversely in relation thereto, preferably, vertically.

According to a preferred embodiment, the arming/disarming device 10 further comprises:

- transmission means 50 connected to the trigger 601 and moveable by it;
- an arming member 100 comprising a plurality of engagement elements 151, 156, 157 suitable for engaging the transmission means 50 and/or the firing pin 6 and/or the locking element 7, According to a preferred embodiment, in fact, the pressure on the trigger 601 results in a movement of the transmission means 50, which engage the arming member 100 which, by rotating, in turn moves the locking element 7 to lock or unlock the firing pin 6 and engage or disengage said firing pin 6. In a preferred embodiment, as described below, the locking element 7 is usually in a locked position and upon movement of the arming member 100 is moved into an unlocked position.

According to a preferred embodiment, said transmission means 50 comprise a transmission lever 51 with one end connected to the trigger and the other end 601 engaging the arming member 100.

According to a preferred embodiment, the arming member 100 comprises:

- a firing pin operating body 110 comprising the firing pin engagement element 156 for engagement with the firing pin 6;
- a lock operating body 120 comprising the transmission engagement element 151 for engagement with the transmission means 50 and the lock engagement element 157 for engagement with the locking element 7 of the firing pin 6.

Preferably, the firing pin operating body 110 is engageable in rotation by the lock operating body 120 to in turn be moved in rotation; in the following description, the respective elements of the two components specifically designed to allow this interaction during rotation will be extensively described.

In other words, in said preferred embodiment, the arming member comprises two separate components with specific and distinct roles in the firing mechanism; preferably, such components are designed to reciprocally engage as a function of their angular arrangement in the performance of their respective roles.

According to a preferred embodiment, the arming member 100 further comprises a support pin 200 for the rotatable support of the firing pin operating body 110 and of the lock operating body 120 to permit the mutual engagement of the components.

Preferably, the support pin 200 extends along a transversal axis X-X to the firearm 1, in which the firing pin operating body 110 and the lock operating body 120 are mounted coaxially onto the support pin 200.

In other words, the support pin 200 extends transversely to the longitudinal axis Z-Z; where the transversal axis X-X is for example, perpendicular to the longitudinal axis Z-Z. Preferably, this way the support pin 200 cooperates transversely with the firearm 1, in particular in some embodiments it cooperates with the support frame 500, e.g. with the two wings 501 and 502.

According to a preferred embodiment, the pin 200 is translatable along said transversal axis X-X, and the components of the arming member 100 are suitable to be fitted on it.

According to a preferred embodiment, the locking element 7 is kept in a locked position in which it prevents the movement of the firing pin 6, and is movable into an unlocked position which allows the movement of the firing pin 6; preferably, the locking element 7 is moved into said unlocked position by the lock operating body 120 in the phases of the firing cycle in which the transmission means 50 engage the transmission engagement element 151.

In other words the locking element 7 is suitable to be engaged by the lock operating body 120 for its vertical translation, depending on the transmission means, wherein said locking element 7 is kept in a lowered position, thus locking the firing pin, by special elastic pressure elements 71, such as a coil spring, insisting on the locking element 7. The thrust action on the transmission means 50, through pressure on the trigger, which induces the lock operating body 120 to rotate must overcome said action of the elastic pressure element 71.

According to a preferred embodiment, the engagement element 151 extends laterally, for example parallel to the support pin 200, thus parallel to the transversal axis X-X, and is therefore engageable in thrust by the transmission means 50.

Preferably, respectively on their tops, the firing pin operating body 6 has the firing pin engagement element 156 and the lock operating body 120 has the lock engagement element 157, both said components extend radially relative to the support pin 200 so as to engage the firing pin 6 and the engagement element 7 located in the firearm in a position above the arming member 100. According to a preferred embodiment, the firing pin engagement element 156 engages the firing pin 6, at a firing pin tooth 61, preferably, located in the rear area.

In said rear area moreover, the firing pin spring 69 is also located suitable to compress itself during the firing cycle following the engagement between the firing pin operating body and 110 and the firing pin 6.

According to a preferred embodiment, the transmission means 50 are placed in translation by actuating the trigger 601, identifying a predefined stroke in translation.

Preferably, the translation of the transmission means 50 is composed of a series of pre-defined strokes: a pre-stroke, a stroke and an extra-stroke.

In other words, the pre-stroke is the translation stroke in which the transmission means 50 translate until achieving contact with the lock operating body 120, in particular with the transmission engagement element 151.

The active stroke is the stroke in which the translation means 50 move the lock operating body 120 in rotation, as far as bringing the locking element 7 into an unlocked position and simultaneously moving the firing pin operating body 110 in rotation until it disengages from the firing pin 6.

The extra-stroke is the stroke in which the transmission means 50 translate until the trigger 601 reaches the end of its rearward stroke. In particular, the extra-stroke is needed and ever-present to ensure, in any condition of dimensional tolerances of the different components, the disengagement of the firing pin 6 from the firing pin operating body 110, and in particular of the firing pin element 156.

In addition, it is to be noted that the sum of the active stroke and the extra-stroke is called "reset", i.e. the minimum forward stroke which the trigger, and thus the transmission means must make to make the next shot fireable.

Work on the strokes, and therefore on the size and positioning of the different components is therefore essential for making the firearm as ready as possible.

In particular, in a preferred embodiment, the beginning of the movement of the locking element 7 upon the action of the lock operating body 120 occurs before or at the latest simultaneously with the beginning of the disengagement of the firing pin operating body 110 from the firing pin 6.

In other words, an angular gap is preferably, present between the lock operating body 120 and the firing pin operating body such that for a first angular portion the lock operating body 120 turns on its own and then simultaneously with the firing pin operating body 110. Preferably, said angular distance is between 0 and 4 degrees.

In a preferred embodiment, the beginning of the movement of the locking element 7 corresponds concurrently with the start of the active stroke.

According to a preferred embodiment, the arming member 100 comprises elastic means 300 suitable to engage the firing pin operating body 110 and the lock operating body 120 to keep them respectively in predefined angular positions when not engaged by or with the respective components. Preferably, said elastic means 300 are in turn fitted on the support pin 200 and engage the different bodies.

Preferably, in fact, the elastic means 300 comprise a torsion spring lock 320 suitable to act on in torsion on the lock operating body 120 to keep it in a position of contact with the locking element 7, i.e. to keep the lock engagement element 157 in contact with the locking element 7. This way, the lock operating body 120, when engaged by the transmission means 50 is instantly ready to impress an action on the locking element 7 to move it height-wise and place it in an unlocked position, starting from the locked position which it is kept in by the elastic pressure element 71.

Preferably, the lock torsion spring 320 is a coil spring.

In particular, the torsion spring lock 320 is housed in a sandwich between the firing pin operating body 110 and the lock operating body 120 acting with the two ends respectively on both components.

In a preferred embodiment, the firing pin operating body 110 and the lock operating body 120 respectively comprise the gripping and thrust elements, which extend, preferably, parallel to the transversal axis X-X, for the mutual engagement between the firing pin operating body 110 and lock operating body 120 when placed in rotation.

In other words, the firing pin operating body 110 comprises at least one firing pin operating body gripping and thrust element 111 and the lock operating body 120 comprises at least two lock gripping and thrust elements 121 placed angularly at the sides of the firing pin operating body gripping and thrust element 111; in a further embodiment (not shown in the drawings), it is the firing pin operating body 110 which comprises two gripping and thrust elements while the lock operating body 120 comprises one of such two.

In further embodiments, such as those shown in the appended figures, for example FIGS. 4*a* and 4*b* and 5*a* and 5*b* it is to be noted how the firing pin operating body has two angularly spaced firing pin operating body gripping and thrust elements 111, and the lock operating body has two lock operating body gripping and thrust elements 121 respectively suitable to cooperate with the reciprocal elements on the firing pin operating body 110.

Preferably, therefore, the firing pin operating body gripping and thrust elements 111 and/or lock operating body gripping and thrust elements 121 extend parallel to the transversal axis X-X in opposite directions, in order to achieve the reciprocal engagement between the components.

In the embodiment shown in the figures, the firing pin operating body gripping and thrust elements 111 are the shape of cavities which extend in the direction parallel to the transversal axis X-X while the lock operating body gripping and thrust elements 121 are the shape of protruding pins, parallel to the transversal axis X-X, to be housed in said cavities and act in conjunction with the walls thereof to perform the engagement action.

This way, the movement commanded in rotation by the lock operating body 120 involves a mutual engagement of a lock operating body gripping and thrust element 121 with the firing pin operating body gripping and thrust element 111; upon continuation of said movement in rotation of the lock operating body 120 the firing pin operating body is also rotated by means of said engagement.

Preferably, the lock operating body gripping and thrust element 121, placed above, is suitable to perform said engagement during the rotation.

According to a preferred embodiment, the elastic means 300 comprise a torsion-compression spring 310 suitable to act in compression on the firing pin operating body 110 and on the lock operating body 120 to keep them in place laterally, and suitable to act in torsion on the firing pin operating body 110 to keep it in a return position, for example with the firing pin engagement element 156 raised in height, suitable to perform engagement with the firing pin 6.

In other words, the torsion-compression spring 310 is suitable to keep the firing pin operating body 110 and the lock operating body in place laterally so as to guarantee over time the reciprocal engagement of the two components and, in particular, their position such that engagement with the firing pin 6 and the locking element 7 is guaranteed.

In addition, the torsion-compression spring 310 acts in torsion on the firing pin operating body 110 in order to keep it in an angular position such as to maintain its engagement with the firing pin 6, so that its disengagement is only possible by acting on the trigger 601.

Preferably, the torsion-compression spring 310 is a coil spring.

In particular, the torsion-compression spring 310 comprises a first end 311 engaging the firing pin operating body 110 and a second end 312 engaging a generic fixed element part of the firearm 1, for example the frame 500.

According to a preferred embodiment, the torsion-compression spring 310 has a greater elastic coefficient than the lock torsion spring 320.

In other words, to achieve firing, the trigger action 601 must be such as to overcome the action of the elastic pressure means 71 acting on the locking element 7, the twisting action of the torsion-compression spring 310, the action of the firing pin 69 and the generic return springs on the trigger 609.

Taking by way of a non-limiting example FIGS. 1*a* to 1*m* showing a complete firing cycle, the arming member 100 is suitable to operate distinctly on the locking element 7 in a manner such as to command a movement thereof into an unlocked position solely by operation of the trigger 601, in detail at the end of a firing cycle since the locking element 7 is in a locked position, and thus lowered, and a new and further movement of the trigger is needed for the locking element 7 to be brought back into a new unlocked position thereby allowing the movement of the firing pin 6.

According to a preferred embodiment, in order to keep the arming member 100 in a lateral position along the axis X-X and in particular keep the firing pin operating body 110 and the lock operating body 120 in a lateral position on the pin 200 in such a way that these are axially aligned with the locking element 7 and the firing pin 6, the slide 3 and in particular the obturator comprised therein, has a projecting tab 35 suitable to perform a lateral abutment along the transversal axis X-X to the firing pin operating body 110.

To disassemble the firearm, it is necessary to disengage the firing pin operating body 110 from the firing pin 6 to permit the extraction of the slide.

Typically, in the solutions typical of the prior art it is therefore necessary to pull the trigger, thereby configuring a situation of risk.

According to a preferred embodiment, the arming member 100 is movable along the transversal axis X-X. To permit the aforesaid translation, it is necessary to move the slide 3 backwards to bring the projecting tab into a retracted position along the longitudinal axis Z-Z; in said retracted position it is therefore possible to move the arming member 100 and in particular the firing pin operating body 110 which, in turn, is disengaged from the firing pin 6 by pressing the end of the pin 200.

In other words said operation is safe. To perform it in fact it is not necessary to operate the trigger, and, consequently, the locking element 7 is kept in the firing pin locked position so as to intercept the firing pin 6 and prevent any firing. In yet other words, in the performance of said operation, the lock operating body 120 is not rotated around the transversal axis X-X, but is translated on it.

Innovatively, the firearm which the present invention relates to is characterised by the annulment of the possibility that the firearm has a degree of risk in which the involuntary firing of a shot and/or burst of shots is possible.

Advantageously in fact the firearm according to the present invention, in case of "misfire", i.e. non-firing, with the firearm in the condition of having a shot in the barrel, once the trigger is released, has the locking element in the locked position, thereby blocking the firing pin and thus avoiding that an impact or fall could resulting in an accidental shot being fired.

In addition, advantageously, in the case in which the firing pin, in the case of a normal firing sequence, is not intercepted by the firing pin operating body, for example due to wear or failure thereof, the firing pin is in any case locked by the action of the firing pin operating body.

A further advantageous aspect lies in the fact that the firearm of the present invention is extremely reactive and ready for firing.

Yet a further advantageous aspect, is that it is not necessary for a first portion of the active stroke to be dedicated to moving the lock operating body towards the locking element since these are always mutually engaged; in other words, it is extremely advantageous that the lock operating body is always kept in contact with the locking element so that the movement of the latter is simultaneous to the active stroke in its entirety.

Advantageously, in addition, the rotation between the lock operating body and the firing pin operating body is related to angular distances and to the positioning by designing gripping and thrust elements present on the lock operating body and on the firing pin operating body.

In addition, advantageously the firearm according to the present invention is characterized by a very competitive and contained "reset".

A further advantageous aspect lies in the possibility of being able to design the obturator member of a compact and contained size. For example, the fact that the lock operating body is kept in contact with the locking element means its dimensions can be as contained as possible.

Advantageously, by means of the projecting tab the operating body is kept in a safe lateral position, thereby keeping the lock operating body and the firing pin operating body always aligned with the locking element and with the firing pin, even in the event of a side impact.

In addition, advantageously, to disassemble the firearm no action on the trigger is needed and the firing pin locking element is kept in locked position.

A person skilled in the art may make variations to the embodiments of the aforesaid firearm or replace elements with others functionally equivalent so as to satisfy specific requirements. For example, a solution may be provided for without a support frame, in which the components are mounted and supported directly on the frame.

Further embodiments with different geometries of the pin, for example with special shapes or anti-rotation protuberances, may also be provided for.

In addition, each variant described as belonging to a possible embodiment may be realised independently of the other embodiments.

The invention claimed is:

1. A firearm comprising:

i) a firing mechanism comprising a trigger, a firing pin, and a locking element suitable for being moved to lock or release the firing pin; and ii) an arming device of the firearm comprising:

a transmission means connected to the trigger and moveable by the trigger; and an arming member comprising a plurality of engagement elements suitable for engaging the transmission means or the firing pin or the locking element, in such a way that a pressure of the trigger corresponds to a movement of the transmission means, which, by rotating, engages the arming member which in turn moves the locking element to lock or release the firing pin and engages or disengages said firing pin;

wherein the arming member comprises:

a) a firing pin operating body comprising the firing pin engagement element for engagement with the firing pin;

b) a lock operating body comprising the transmission engagement element for engagement with the transmission means and the lock engagement element for engagement with the locking element of the firing pin, wherein the firing pin operating body is engageable in rotation by the lock operating body to in turn be moved in rotation; and c) a support pin for the rotatable support of the firing pin operating body and of the lock operating body to permit the mutual engagement of the components.

2. A firearm according to claim 1, wherein the locking element is kept in a locked position in which it prevents the movement of the firing pin, and is movable into a release position in which it permits the movement of the firing pin, wherein the locking element is moved into said release position by the lock operating body in the steps of the firing cycle in which the transmission means engage the transmission engagement element.

3. A firearm according to claim 1, wherein the beginning of the movement of the locking element upon the action of the lock operating body occurs before, or at the latest simultaneously with, the beginning of the disengagement of the firing pin operating body from the firing pin.

4. A firearm according to claim 1, wherein the engagement transmission element extends parallel to the support pin, wherein the firing pin engagement element and the lock engagement element extend radially in relation to the support pin.

5. A firearm according to claim 1, wherein the transmission means is placed in translation by actuating the trigger, identifying a predefined stroke in translation, comprising:

a pre-stroke, in which the transmission means translates until achieving contact with the lock operating body in particular with the transmission engagement element;

an active stroke in which the translation means moves the lock operating body in rotation, as far as bringing the locking element into a release position and simultaneously moving the firing pin operating body in rotation until it disengages from the firing pin;

an extra-stroke in which the transmission means translates until the trigger reaches the end of its rearward stroke.

6. A firearm according to claim 5, wherein the beginning of the movement of the locking element corresponds concurrently with a start of the active stroke.

7. A firearm according to claim 1, wherein the support pin extends along a transversal axis (X-X) to the firearm, in which the firing pin operating body and the lock operating body are mounted coaxially onto the support pin.

8. A firearm according to claim 1, wherein the arming member comprises elastic means suitable to engage the firing pin operating body and the lock operating body to keep them respectively in predefined angular positions when not engaged by or with the respective components.

9. A firearm according to claim 8, wherein the elastic means comprises a torsion spring lock suitable to act in torsion on the lock operating body to keep it in a position of contact with the locking element, thereby keeping the lock engagement element in contact with the locking element.

10. A firearm according to claim 9, wherein the torsion spring lock is housed in a sandwich between the firing pin operating body and the lock operating body acting with the two ends respectively on both components.

11. A firearm according to claim 1, wherein firing pin operating body and the lock operating body respectively comprise gripping and thrust elements, which extend parallel to a transversal axis (X-X), for the mutual engagement of the firing pin operating body and lock operating body when placed in rotation.

12. A firearm according to claim 11, wherein the firing pin operating body comprises a firing pin operating body gripping and thrust element and the lock operating body comprises two lock operating body gripping and thrust elements placed angularly to the sides of the firing pin operating body gripping and thrust element, or vice versa.

13. A firearm according to claim 8, wherein the elastic means comprises a torsion compression spring suitable to act in compression on the firing pin operating body and on the lock operating body to keep them in contact laterally, and suitable to act in torsion on the firing pin operating body to keep it in a position of engagement with the firing pin.

14. A firearm according to claim 13, wherein the torsion-compression spring has a greater elastic coefficient than the lock torsion spring.

15. A firearm comprising:

i) a firing mechanism comprising a trigger, a firing pin, and a locking element suitable for being moved to lock or release the firing pin; and ii) an arming device of the firearm comprising:

a transmission means connected to the trigger and moveable by it; and an arming member comprising a plurality of engagement elements suitable for engaging the transmission means or the firing pin or the locking element, in such a way that a pressure of the trigger corresponds to a movement of the transmission means, which, by rotating, engages the arming member which in turn moves the locking element to lock or release the firing pin and engages or disengages said firing pin;

wherein the arming member comprises:

a) a firing pin operating body comprising the firing pin engagement element for engagement with the firing pin;

b) a lock operating body comprising the transmission engagement element for engagement with the transmission means and the lock engagement element for engagement with the locking element of the firing pin, wherein the firing pin operating body is engageable in rotation by the lock operating body to in turn be moved in rotation;

c) a support pin for the rotatable support of the firing pin operating body and of the lock operating body to permit the mutual engagement of the components; and d) an elastic means suitable to engage the firing pin operating body and the lock operating body to keep them respectively in predefined angular positions when not engaged by or with the respective components, the elastic means comprising a torsion spring lock suitable to act in torsion on the lock operating body to keep it in a position of contact with the locking element, thereby keeping the lock engagement element in contact with the locking element, the torsion spring locking being housed in a sandwich between the firing pin operating body and the lock operating body acting with the two ends respectively on both components.

16. The firearm of claim 15, wherein firing pin operating body and the lock operating body respectively comprise gripping and thrust elements, which extend, parallel to the axis (X-X), for the mutual engagement of the firing pin operating body and lock operating body when placed in rotation.

17. The firearm of claim 15, wherein the locking element is kept in a locked position in which it prevents the movement of the firing pin, and is movable into a release position in which it permits the movement of the firing pin, wherein the locking element is moved into said release position by the lock operating body in the steps of the firing cycle in which the transmission means engage the transmission engagement element.

18. A firearm comprising:

i) a firing mechanism comprising a trigger, a firing pin, and a locking element suitable for being moved to lock or release the firing pin; and ii) an arming device of the firearm comprising:

a transmission means connected to the trigger and moveable by it; and an arming member comprising a plurality of engagement elements suitable for engaging the transmission means or the firing pin or the locking element, in such a way that a pressure of the trigger corresponds to a movement of the transmission means, which, by rotating, engages the arming member which in turn moves the locking element to lock or release the firing pin and engages or disengages said firing pin; wherein the arming member comprises:

a) a firing pin operating body comprising the firing pin engagement element for engagement with the firing pin;

b) a lock operating body comprising the transmission engagement element for engagement with the transmission means and the lock engagement element for engagement with the locking element of the firing pin, wherein the firing pin operating body is engageable in rotation by the lock operating body to in turn be moved in rotation;

c) a support pin for the rotatable support of the firing pin operating body and of the lock operating body to permit the mutual engagement of the components; and d) an elastic means suitable to engage the firing pin operating body and the lock operating body to keep them respectively in predefined angular positions when not engaged by or with the respective components, the elastic means comprising a torsion compression spring suitable to act in compression on the firing pin operating body and on the lock operating body to keep them in contact laterally, and suitable to act in torsion on the firing pin operating body to keep it in a position of engagement with the firing pin.

19. The firearm of claim 18, wherein the torsion-compression spring has a greater elastic coefficient than the lock torsion spring.

20. The firearm of claim 18, wherein the beginning of the movement of the locking element upon the action of the lock operating body occurs before, or at the latest simultaneously with, the beginning of the disengagement of the firing pin operating body from the firing pin.

* * * * *